US009342054B2

(12) United States Patent
White et al.

(10) Patent No.: US 9,342,054 B2
(45) Date of Patent: May 17, 2016

(54) APPARATUS AND METHOD OF KEEPING TIME OF DAY OVER AN INDUSTRIAL TEMPERATURE RANGE

(75) Inventors: Bertram John White, Irvine, CA (US); Nathan Theodore Hackett, Corona, CA (US)

(73) Assignee: Maxim Integrated Products, Inc., San Jose, CA (US)

( * ) Notice: Subject to any disclaimer, the term of this patent is extended or adjusted under 35 U.S.C. 154(b) by 854 days.

(21) Appl. No.: 13/431,143

(22) Filed: Mar. 27, 2012

(65) Prior Publication Data

US 2012/0250469 A1 Oct. 4, 2012

Related U.S. Application Data

(60) Provisional application No. 61/470,410, filed on Mar. 31, 2011.

(51) Int. Cl.
*G04G 3/04* (2006.01)

(52) U.S. Cl.
CPC ..... *G04G 3/04* (2013.01)

(58) Field of Classification Search
CPC ..... G04G 3/04
USPC ..... 368/46, 160
See application file for complete search history.

(56) References Cited

U.S. PATENT DOCUMENTS 4,513,259 A * 4/1985 Frerking ..... 331/176
5,461,652 A * 10/1995 Hongo ..... 368/156
5,644,271 A * 7/1997 Mollov et al. ..... 331/176
5,767,747 A * 6/1998 Pricer ..... 331/46
6,292,062 B1 * 9/2001 Bourk et al. ..... 331/46
6,304,517 B1 * 10/2001 Ledfelt et al. ..... 368/10
7,660,612 B2 2/2010 Bultan et al.
8,391,105 B2 * 3/2013 Raymond ..... 368/46
2008/0117722 A1 * 5/2008 Ahuja et al. ..... 368/202

FOREIGN PATENT DOCUMENTS

CN 1234119 A 3/1999
CN 101124735 A 2/2008

OTHER PUBLICATIONS

Office Action dated Oct. 10, 2015, in related Chinese Patent Application No. 2012100920705, filed Mar. 30, 2012 (24pgs.).

* cited by examiner

*Primary Examiner* — Amy Cohen Johnson
*Assistant Examiner* — Jason Collins
(74) *Attorney, Agent, or Firm* — North Weber & Baugh LLP

(57) ABSTRACT

Various embodiments of the invention relate generally to real-time clock circuit, and more particularly to systems, devices and methods of integrating two oscillators in one real-time clock circuit to generate accurate time of day over an industrial temperature range. A primary oscillator is employed to generate a first high precision clock while having a higher frequency and consuming more power; a secondary oscillator is employed to generate a second clock that has a low frequency and consumes less power, but may not meet the time accuracy requirement. When the real-time clock is provided with sufficient power (MSN mode), time of day is constantly tracked by the primary oscillator, but when the real-time clock is powered by a battery (SLEEP mode), time of day is tracked by the secondary oscillator while the primary oscillator is switched on at an update frequency to compensate errors in the time of day.

20 Claims, 5 Drawing Sheets

APPARATUS AND METHOD OF KEEPING TIME OF DAY OVER AN INDUSTRIAL TEMPERATURE RANGE

CROSS REFERENCE TO RELATED APPLICATIONS

This application claims the benefit under 35 U.S.C §119(e) of Provisional Application Ser. No. 61/470,410, entitled "Apparatus and Method of Keeping Time of Day Over an Industrial Temperature Range," filed on Mar. 31, 2011, the subject matter of which is incorporated herein by reference in its entirety.

BACKGROUND

A. Technical Field

The present invention relates generally to real-time clock circuits, and more particularly to methods, systems and devices that employ two oscillators in a real-time clock circuit to generate accurate time of day over an industrial temperature range for electronic applications.

B. Background of the Invention

Time of day is tracked by a real-time clock (RTC) circuit in computers and embedded systems. In addition to a primary power source, the RTC circuit requires a secondary power source which is normally a lithium battery to track the time of day continuously when the primary power source is discontinued. The core of the RTC circuit is a crystal oscillator that has a typical resonant frequency of 32.768 kHz. Such a crystal oscillator is also used in quartz clocks and watches, and therefore the particular crystal in the oscillator is also called a "watch crystal." Since this watch crystal generates $2^{15}$ clock cycles per second, a RTC circuit based on the watch crystal may be easily implemented using binary counter circuits for use in various electronic applications. Moreover, the watch crystal needs low power consumption that can be easily sustained by both of the primary and secondary power source.

Some electronic applications may impose stringent requirements on the accuracy of the time measurement that is provided by the RTC circuit. For instance, in an electric powermeter, accuracy specifications for the time of day are such that time drift within one day has to be less than 5.78 ppm (i.e., 0.5 second/day) at the room temperature (25° C.) and less than 11.57 ppm (i.e. 1 second/day) over an industrial temperature range of [−25° C., 60° C.]. These accuracy specifications are also adopted in various electronic devices, and some devices even requires the latter specification on drift of time of day within one day, 11.57 ppm, to be applied to a wider temperature range, [−40° C., 85° C.].

In order to maintain a highly accurate time of day, the oscillator circuit needs to compensate the temperature drift caused by the watch crystal. The watch crystal is normally built in a tuning fork configuration. The resonant frequency (32.768 kHz) of the watch crystal reaches a peak at a turnover temperature $T_t$, and drops as the temperatures increases or decreases, resulting in a significant quadratic error. This error ERR(T) may be represented as $$\mathrm{ERR}(T)=A+Q(T-T_t)^2 \text{ ppm} \quad (1)$$

where A is initial error tolerance in ppm, and Q is quadratic coefficient in ppm/° C.$^2$. Typical manufacturing limits are 25° C.±5° C. for $T_t$ and −0.036 ppm/° C.$^2$±10% for Q, respectively. Since a frequency is the reciprocal of the period of a clock cycle, a drift of the resonant frequency is equal to the drift of time of day, and the frequency drift may be thus used to represent the drift of the time of day associated with the particular RTC circuit.

FIG. 1A illustrates the error of the resonant frequency 100 in various watch crystals. Curve 102 is associated with a nominal watch crystal, while curves 104-106 and curves 108-110 are associated with two corner cases of the turn over temperature, $T_t$. For each corner case of Tt, two corner cases of the quadratic coefficient, Q, are presented as well. In particular, in watch crystals having a large quadratic coefficient Q, the error reaches up to −120 ppm at −25° C. If an error tolerance of [−10 ppm, 10 ppm] is imposed on the resonant frequency, most watch crystals may only work within a temperature range that is much narrower than either of the above industrial temperature ranges.

A convenient solution is to integrate a temperature measurement circuit in the oscillator circuit, and compensate the resonant frequency to the nominal value at the room temperature (close to $T_t$). FIG. 1B illustrates the temperature-compensated error of the resonant frequency 150 in various watch crystals in reference to the nominal watch crystal. The nominal watch crystal has a flat error at 0 ppm due to temperature compensation, and thus, the initial error at 25° C. is trimmed to zero. Curves 154-156 and curves 158-160 are associated with two corner cases of turn over temperature, $T_t$. Therefore, the temperature-compensated error of the resonant frequency falls below 30 ppm at −25° C. which is still beyond the aforementioned requirement of 11 ppm. Thus, in order to meet an 11 ppm spec, watch crystals must be individually characterized so that the temperature compensation circuit may be properly programmed.

SUMMARY OF THE INVENTION

The present invention relates generally to an integrated circuit that generates time of day in electronic applications. Various embodiments of the present invention provide systems, devices and methods of integrating two oscillators in one real-time clock circuit to generate accurate time of day over an industrial temperature range.

A primary oscillator is employed to generate a first high precision clock while having a higher frequency and consuming more power; a secondary oscillator is employed to generate a second clock that has a low frequency and consumes less power, but may not meet the time accuracy requirement. When the real-time clock is provided with sufficient power (MSN mode), time of day is constantly tracked by the primary oscillator, but when the real-time clock is powered by a battery (SLEEP mode), time of day is tracked by the secondary oscillator while the primary oscillator is switched on at an update frequency to compensate errors in the time of day.

One aspect of the present invention is a precision time keeping circuit in a real-time clock. The precision time keeping circuit comprises a primary oscillator, a secondary oscillator, a compensation circuit, a time keeping counter and a temperature compensation circuit for the primary oscillator. The compensation circuit further comprises an XCLK accumulator, an update enable generator and comparator logic. Regardless of the power mode, the XCLK accumulator counts the equivalent number of primary clock cycles to a predetermined number XSEC so as to enable a one-second control for the time keeping counter. However, in the power-sensitive SLEEP mode, the XCLK accumulator counts by the secondary clock cycles. The primary clock is switched on for the purpose of calibration at each update cycle, and time error caused by the secondary clock is compensated thereafter.

Another aspect of the present invention is the method of accurately tracking the time of day over an industrial temperature range in both MSN and SLEEP modes. In the MSN mode, the primary clock cycles are accumulated directly to track the time of day. In the SLEEP mode, the number of equivalent primary clock cycles is accumulated in each secondary clock cycle. Calibration is implemented at an update frequency to compensate the time drift associated with the secondary clock. Although this calibration process for the secondary clock is used only in the SLEEP mode, another calibration is applicable in both power modes for updating a number XSEC associated with the total number of primary clock cycles in one second.

Certain features and advantages of the present invention have been generally described in this summary section; however, additional features, advantages, and embodiments are presented herein or will be apparent to one of ordinary skill in the art in view of the drawings, specification, and claims hereof. Accordingly, it should be understood that the scope of the invention shall not be limited by the particular embodiments disclosed in this summary section.

BRIEF DESCRIPTION OF THE DRAWINGS

Reference will be made to embodiments of the invention, examples of which may be illustrated in the accompanying figures. These figures are intended to be illustrative, not limiting. Although the invention is generally described in the context of these embodiments, it should be understood that it is not intended to limit the scope of the invention to these particular embodiments.

DETAILED DESCRIPTION OF THE PREFERRED EMBODIMENTS

Figure 1A:
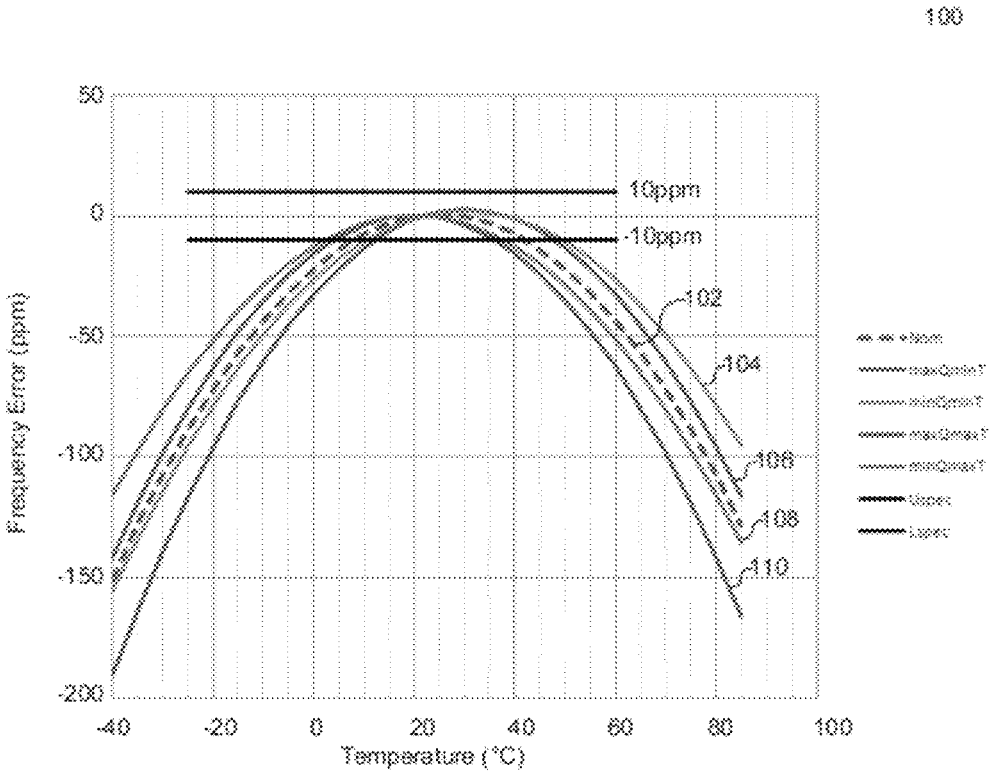
FIG. 1A illustrates the error of the resonant frequency in various watch crystals.
Figure 1B:
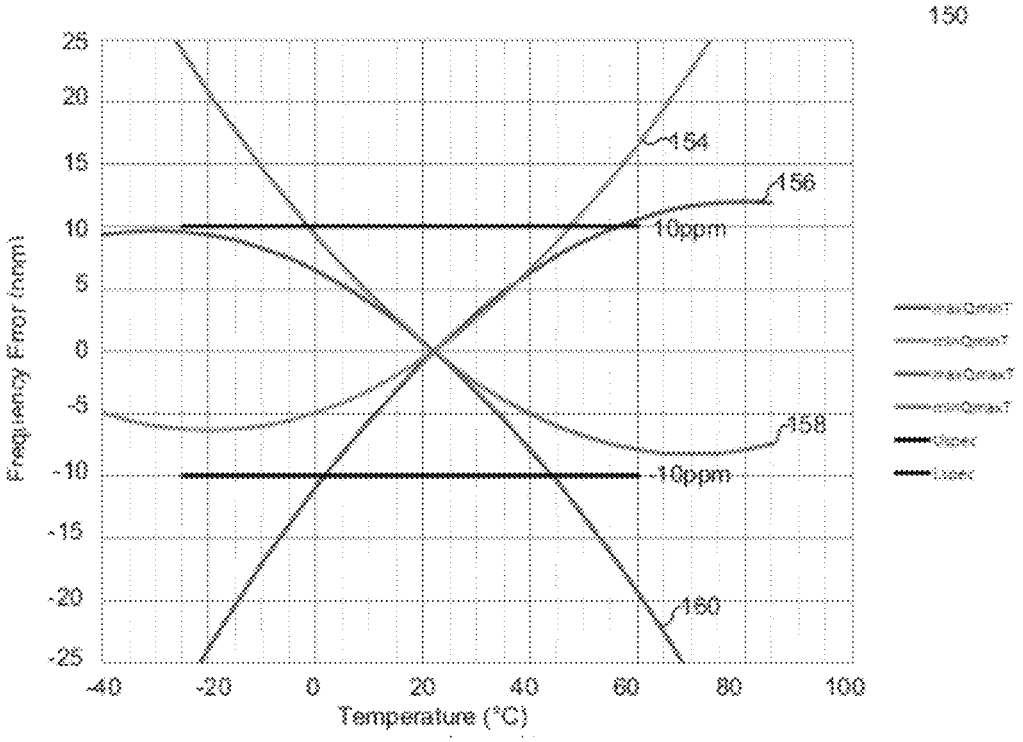
FIG. 1B illustrates the temperature compensated error of the resonant frequency in various watch crystals in reference to the nominal watch crystal.

The present invention relates generally to integrated circuits that generate time of day in electronic applications. Various embodiments of the present invention provide systems, devices and methods of integrating two oscillators in one real-time clock circuit to generate accurate time of day over an industrial temperature range. In the following description, for purposes of explanation, specific details are set forth in order to provide an understanding of the invention. It will be apparent, however, to one skilled in the art that the invention can be practiced without these details. One skilled in the art will recognize that embodiments of the present invention, described below, may be performed in a variety of ways and using a variety of structures. Those skilled in the art will also recognize additional modifications, applications, and embodiments are within the scope thereof, as are additional fields in which the invention may provide utility. Accordingly, the embodiments described below are illustrative of specific embodiments of the invention and are meant to avoid obscuring the invention.

Reference in the specification to "one embodiment" or "an embodiment" means that a particular feature, structure, characteristic, or function described in connection with the embodiment is included in at least one embodiment of the invention. The appearance of the phrase "in one embodiment," "in an embodiment," or the like in various places in the specification are not necessarily all referring to the same embodiment.

Furthermore, connections between components or between method steps in the figures are not restricted to connections that are effected directly. Instead, connections illustrated in the figures between components or method steps may be modified or otherwise changed through the addition thereto of intermediary components or method steps, without departing from the teachings of the present invention.

In electronic applications, the time of day is consistently tracked in two power modes, a mission (MSN) mode and a SLEEP mode. In the MSN mode, a primary power source is employed and the power/current requirement is relatively flexible, while in the SLEEP mode, a secondary power source, most probably a battery, is used and power consumption has to be suppressed at a low level. In both MSN and SLEEP power mode, various embodiments in the present invention meet more stringent accuracy requirements for the time of day than a conventional requirement that a watch crystal may easily meet. One example of the time of day requirement is that time drift within one day is less than 5.78 ppm, i.e., 0.5 second/day, at the room temperature (25° C.), and less than 11.57 ppm, i.e., 1 second/day, within an industrial temperature range of [−25° C., 60° C.].

In various embodiments in the present invention, two oscillators are integrated in the real-time clock circuit to generate accurate time of day over the industrial temperature range in both MSN and SLEEP modes. In the MSN mode, power budget is less critical, and therefore, a high-precision primary oscillator (e.g., an AT cut crystal oscillator) may be applied to track the time of day despite its potentially large power consumption. However, in the SLEEP mode, power budget is more critical, and a low-power secondary oscillator is preferred to replace the primary oscillator. The secondary oscillator may be a relatively coarse oscillator that may not meet the time of day requirements, but it consumes much less power. The existing primary oscillator may be applied as a calibration oscillator, being turned on at a certain calibration/update frequency to compensate the time error introduced by the secondary oscillator. In some simple embodiments the update frequency may be fixed or specified while more complex embodiments may vary the update frequency dynamically based on parameters that are deemed predictive of the drift in the secondary oscillator.

Figure 2:
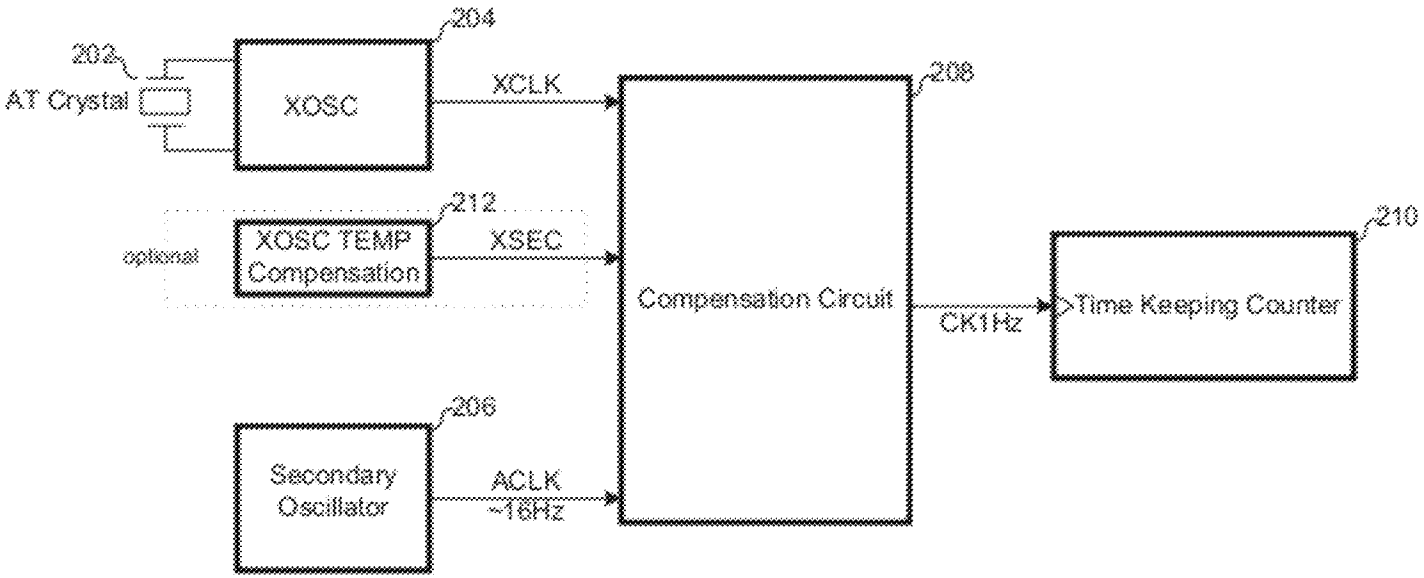
FIG. 2 illustrates an exemplary block diagram of a precision time keeping circuit in the real-time clock circuit according to various embodiments in the present invention.

FIG. 2 illustrates an exemplary block diagram 200 of a precision time keeping circuit in the real-time clock circuit according to various embodiments in the present invention. The precision time keeping circuit 200 comprises an AT crystal 202, an XOSC oscillator circuit 204, a secondary oscillator 206, a compensation circuit 208, and a time keeping counter 210. The AT crystal 202 is applied as a primary oscillator. The XOSC oscillator circuit 204 is coupled to the AT crystal 202, and generates a first clock signal XCLK. A secondary oscillator 206 generates a second clock signal ACLK. The compensation circuit 208 is coupled to both the XOSC oscillator circuit 204 and the second oscillator 206, and generates a one-second control CK1Hz that is enabled every time a precise one second has passed. The time keeping counter 210 is coupled to the compensation circuit 208, and tracks the time of day based on the one-second control CK1Hz.

The AT cut crystal 202 is employed as the primary oscillator. The AT cut crystal 202 share the same source crystal with the watch crystal except that it is cut along different crystal orientations. The AT crystal 202 inherently has better accuracy than the watch crystal, and the drift of the resonant frequency is less than ±10 ppm over a temperature range of [−20° C., 70° C.], almost overlapping the industrial temperature range of [−25° C., 60° C.]. The disadvantage of the AT cut crystal 202 is that it operates at a frequency higher than that of the watch crystal, and therefore, consumes more current. In certain embodiments, a watch crystal oscillator runs at 32.768 kHz and requires a current of less than 1 μA, while an AT crystal oscillator runs at 16 MHz and may require a current of 100 μA. Therefore, in a RTC circuit powered by a battery when the primary power source is shut off (i.e., SLEEP mode), the AT cut crystal 202 may not be constantly used despite its desirable precision over the industrial temperate range.

The secondary oscillator 206 may be a watch crystal oscillator, or a self contained CMOS oscillator, e.g., a relaxation oscillator or a RC oscillator. The RC oscillator may be a phase-shift oscillator, a ring oscillator, or a Wien bridge oscillator. Although the secondary oscillator normally needs a low drive current and consumes a small amount of power, it may be associated with a relatively low accuracy. In certain embodiments, the watch crystal oscillator may only need a drive current of 1-2 μA while the time error may reach −120 ppm at −25° C., and even if a temperature compensation circuit is applied, the error may still reach 30 ppm at −25° C. In order to tackle this accuracy problem, the primary clock may be used to calibrate the secondary oscillator and compensate the resulting time errors.

The precision time keeping circuit 200 may further comprise an XOSC temperature compensation circuit 212. The circuit 212 measures the temperature and determines parameters used for calculating amount of compensation needed. A number of XOSC clock cycles within one second (XSEC) is derived from the temperature and the parameters to compensate the time error introduced by temperature drift. The parameters involved in compensation may include linear, quadratic, and cubic coefficients. These parameters may be predetermined according to various crystal oscillators, and may be programmable using fuses or one-time programmable (OTP) memory for each specific AT crystal oscillator when the circuit is first integrated. Therefore, the XOSC temperature compensation circuit 212 may ensure output of a high-fidelity first clock signal XCLK over the industrial temperature range of [−25° C., 60° C.]. In certain embodiments, the AT crystal oscillator has a negligible temperature drift, and the XOSC temperature compensation circuit 212 may not be needed.

In both power modes (MSN or SLEEP), both the AT crystal oscillator and the secondary oscillator are involved except in different manners. In the MSN mode, the AT crystal oscillator is constantly active, and the time of day is tracked by counting the clock cycles associated with the first clock signal XCLK. The secondary oscillator may be switched on frequently to verify the accuracy of the second clock ACLK. When the power mode is switched to the SLEEP mode, the secondary oscillator is constantly active, and the time of day is tracked by counting the equivalent XCLK clock cycles associated with each cycle of the second clock signal ACLK. The AT crystal oscillator is switched on frequently to identify a time error accumulated since last calibration, and hence, compensate the time error by the compensation circuit 208.

Figure 3:
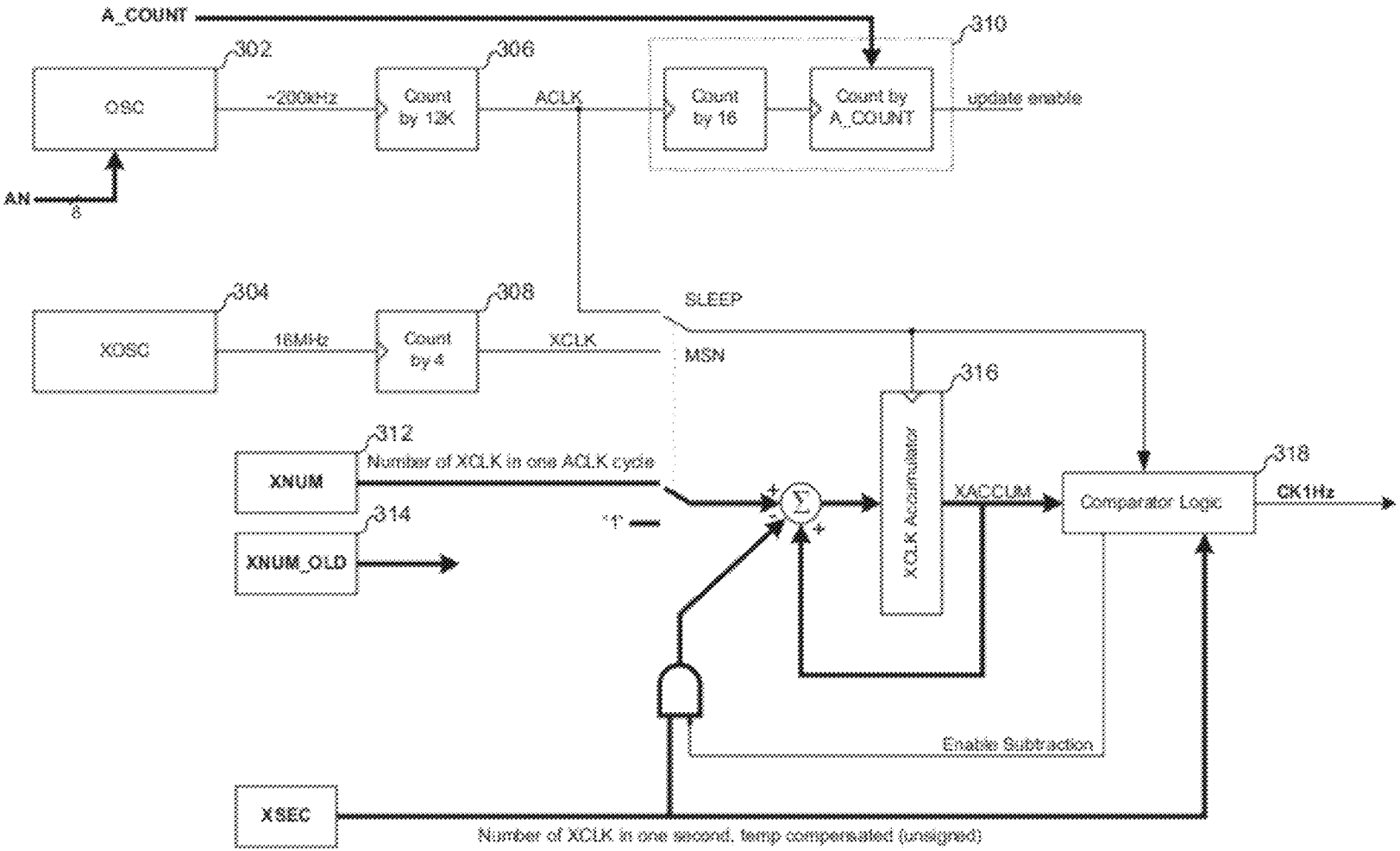
FIG. 3 illustrates an exemplary block diagram of a compensation circuit in a precision time keep circuit according to various embodiments in the present invention.

FIG. 3 illustrates an exemplary block diagram 300 of a compensation circuit in a precision time keep circuit according to various embodiments in the present invention. The compensation circuit 300 is coupled to two oscillator circuits, OSC 302 and XOSC 304, which provide a low frequency clock and a high frequency clock, respectively. In one embodiment, the OSC circuit 302 is coupled to receive a multiple bit frequency trimming control AN to generate a clock within a 10% range of 200 kHz, while the XOSC 304 is based on an AT crystal, and generates a clock at 4 MHz. In certain embodiments, the clocks generated from the oscillator circuits 302 and 304 are directly employed as ACLK and XCLK by the compensation circuit 300. In certain embodiments, prior to use in compensation, the frequency of the clock at 200 kHz may be further reduced to 16 Hz by a divide-by-12K frequency divider 306, and the frequency of the clock at 16 MHz may be reduced to 4 MHz by a divide-by-4 frequency divider 308. Both frequency dividers 306 and 308 may be implemented in digital counters. In particular, the frequency divider 306 is used to improve the precision of XNUM at the expense of calibration time, while the frequency divider 308 is used to improve power consumption in the MSN mode at the expense of XNUM precision.

Table 1 lists exemplary inputs and outputs of the compensation circuit 300 in addition to XCLK and ACLK. A_COUNT is a multiple bit signal that is predetermined by users to define the number of secondary clock cycles between two consecutive calibrations/updates. AN is a frequency trimming control for the clock ACLK. XNUM is an intermediate signal, and it is a multiple bit signal tracking the number of XCLK cycles in one ACLK cycle. XNUM is used in the SLEEP mode and may be ignored in the MSN mode. XNUM_OLD is also a multiple bit signal that is equal to XNUM from a last update. XSEC is a multiple bit signal associated with the number of XCLK in one second. This value is nominally constant, and may be updated with temperature when the XOSC temperature compensation circuit is applied. CK1 HZ is generated as a one-second control to enable time tracking by seconds in the real time clock (RTC) on every rising edge. In certain embodiments, CK1 HZ is a precise 1 second clock in the MSN mode, and may update approximately at a 16 Hz rate in the SLEEP mode.

The compensation circuit 300 comprises an update enable generator 310, a XNUM counter 312, a XNUM_OLD storage 314, a XCLK accumulator 316, and a comparator logic 318. The circuit 300 is coupled to receive the ACLK and XCLK clocks, and generates a one-second control CK1Hz for a subsequent time keeping counter. The update enable generator 310 is coupled to receive the update control A_COUNT, and generates an update enable signal. The XNUM counter 312 is coupled to receive the update enable, ACLK and XCLK, and in one embodiment, the counter 312 counts the number (XNUM) of XCLK cycles within one ACLK cycle at the rising edges of the updates enable. The XNUM_OLD storage is constantly refreshed to store XNUM from a previous update.

TABLE 1

Exemplary Inputs and Outputs of a Compensation Circuit Integrated in a Precision Time Keeping Circuit of a Real-Time Clock

| Signal | Type | Description |
|---|---|---|
| A_COUNT | User-Defined | An update control signal, determining the frequency to update XSEC and XNUM. In SLEEP mode, it also determines when the XOSC will be powered. |
| AN | Manufacturing Trim | Frequency-trimming control, trimming the frequency of the secondary oscillator to 200 kHz ± 10% at 25° C. |
| XNUM | Compensation | A multiple bit signal, binary representation of the number of XCLK cycles in one ACLK cycle. It is updated upon receiving A_COUNT. XNUM is ignored in the MSN mode. |
| XNUM_OLD | Compensation | A multiple bit signal, equal to XNUM from a last update. It is only used in the SLEEP mode. |
| XSEC | Compensation | A multiple bit signal, binary representation of the number of XCLK in one second. This value is nominally constant, and may be updated with temperature when the XOSC temperature compensation circuit is applied. |
| CK1HZ | Output to Time Keeping Counter | A one-second control, enabling time tracking in the real time clock (RTC) on every rising edge. In the MSN mode, this is a precise 1 second clock. In SLEEP mode, it updates approximately at a 16 Hz rate. |

The XCLK accumulator 316 is the core of the compensation circuit 300. Time is tracked by monitoring the number of XCLK clock cycles (XACCUM) continuously. The equivalent number of XCLK clock cycles is accumulated to XACCUM in the XCLK accumulator 316 during each ACLK clock cycle. Once XACCUM reaches the number XSEC, a time period of one second has passed, and XSEC is deducted from XACCUM in the XCLK accumulator 316. The comparator logic 318 is used to compare XACCUM and XSEC at each ACLK cycle, and generate the one-second control CK1Hz and an enable subtraction signal subsequently used in the time keeping counter and the XCLK accumulator 316, respectively.

The XCLK accumulator 316 counts the number of XCLK clock cycles according to different power mode. In the MSN mode, the XCLK accumulator 316 is directly coupled to the XOSC oscillator, i.e., the AT cut crystal oscillator, and counts the number of XCLK clock cycle up to XSEC before the number XACCUM is reset to zero. In the SLEEP mode, the XCLK accumulator 316 is coupled to the OSC oscillator, i.e., the secondary oscillator. The number XACCUM increases by XNUM for each ACLK clock cycle until XACCUM reaches beyond XSEC, and then, XSEC is deducted from XACCUM.

Since the ACLK clock may have a time drift beyond the accuracy requirement, calibration is needed in relevance to the high precision XCLK clock in the SLEEP mode. Calibration occurs at the rising edges of the update enable. The frequency of calibration is defined by the update control signal A_COUNT which represents the number of ACLK cycles between two calibrations. In certain embodiments, the calibration frequency is approximately once per second or once per minute as defined by the number A_COUNT.

In various embodiments of the present invention, the update enable circuit 310 may be implemented by simple digital counters. Upon receiving the update enable control at each update, the AT crystal oscillator XOSC is switched on for a short duration, and its clock cycles are counted within one ACLK clock cycle to refresh the number XNUM. In certain embodiments, XNUM is different from XNUM_OLD measured from the previous calibration, which indicates that the ACLK clock frequency has drifted. In order to account for the time drift since last calibration, a certain number of XCLK clock cycles are derived to compensate the accumulated XCLK cycles XACCUM. This number of XCLK cycles for compensation is represented as $$XCOMP=\tfrac{1}{2}*(XNUM-XNUM_OLD)*A_COUNT \quad (2)$$

where each of A_COUNT ACLK clock cycles is compensated with ½*(XNUM−XNUM_OLD) XCLK clock cycles since last calibration. The compensation amount ½*(XNUM−XNUM_OLD) is derived based on an assumption that clock frequency and time drifts at a linear manner between two calibrations.

Figure 4:
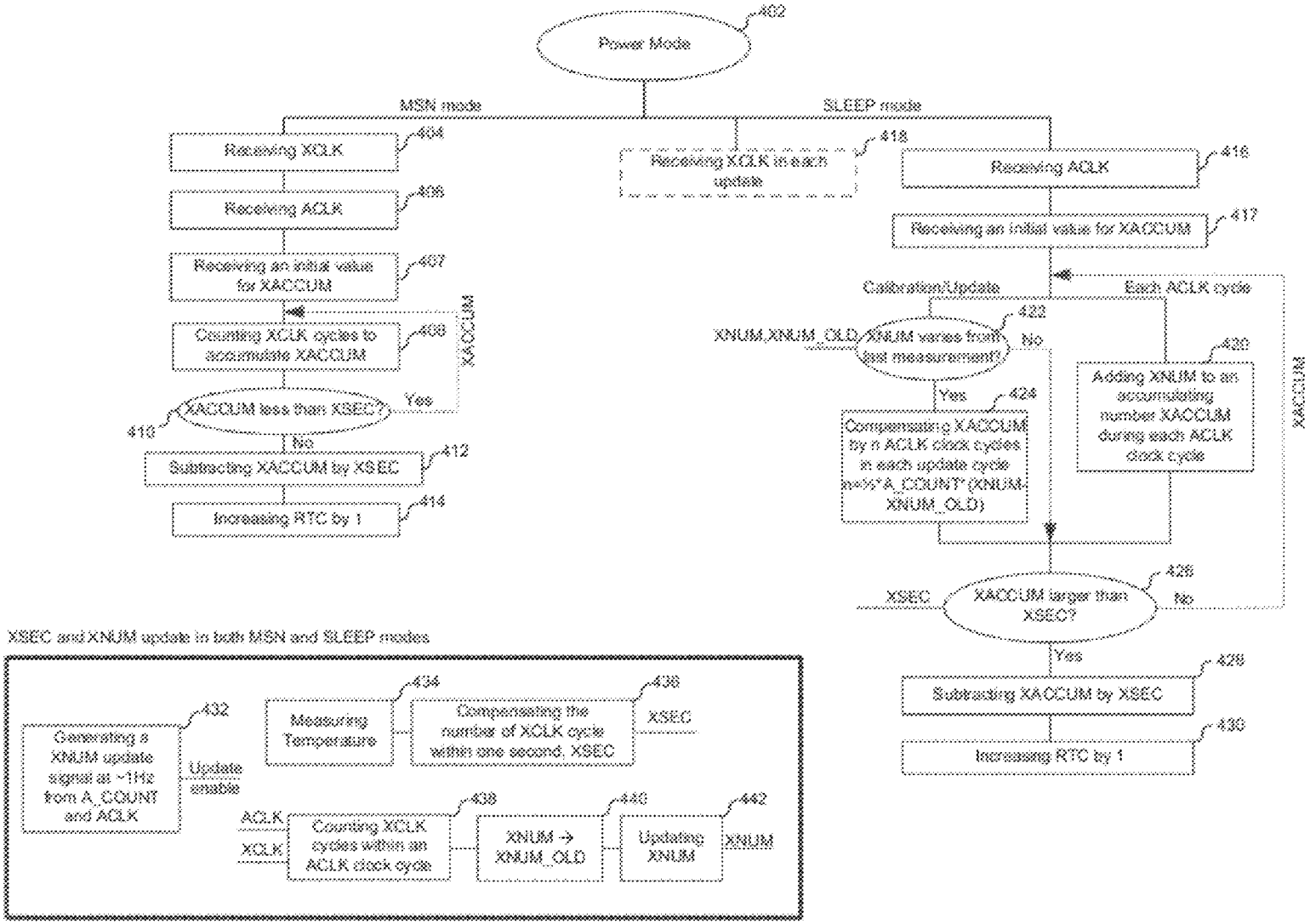
FIG. 4 illustrates a method of tracking each second for accurate time of day in both MSN and SLEEP power modes according to various embodiments in the present invention.

FIG. 4 illustrates a method 400 of tracking each second for accurate time of day in both MSN and SLEEP power modes according to various embodiments in the present invention. The power mode is determined as the MSN or SLEEP mode at step 402. In the MSN mode, a first clock signal XCLK is received at step 404. In certain embodiments, XCLK is generated by an AT crystal oscillator having high precision while consuming more power. A second signal ACLK may also be received at step 406. ACLK is a coarse clock, has a lower frequency than XCLK, and consumes much less power. The XCLK clock cycles are counted by accumulating a number XACCUM at step 408. The initial value of XACCUM is receiving from last second at step 407. At each XCLK clock cycle, the number XACCUM is compared with a predetermined number XSEC at step 410, and XSEC is the number of XCLK clock cycles within one second. If XACCUM is less than XSEC, the process returns to step 408 in which the XCLK clock cycles are continuously counted; otherwise, if XACCUM is equal to or larger than XSEC, XSEC is deducted from XACCUM at step 412, and the real-time clock may be increased by one second at step 414.

In the SLEEP mode, the second clock ACLK is received at step 416. The first clock signal XCLK is switched on for short durations and received at a certain update frequency at step 418. An initial value for XACCUM is adopted at step 417 from a previous second in a MSN or SLEEP mode. During each update cycle, a number XNUM is accumulated to XACCUM at step 420 for each ACLK clock cycle. The number XNUM is the number of XCLK clock within one ACLK clock cycle, and is refreshed at the beginning of the update cycle. The number XNUM is compared with a number XNUM_OLD at step 422. XNUM_OLD is equal to XNUM obtained from a precedent update cycle. At step 424, XACCUM is compensated with XCOMP cycles of the XCLK clock where XCOMP may be represented as equation (2). Step 420 occurs regularly at each ACLK clock cycle while steps 422 and 424 are implemented only at the beginning of each update cycle when XNUM is calibrated. XACCUM is compared to XSEC following both step 420 and step 424. If XACCUM is less than XSEC, then steps 420-426 are repeated. Otherwise, if XACCUM is equal to or larger than XSEC, XSEC is deducted from XACCUM at step 428, and the real-time clock may be increased by one second at step 430.

The numbers XSEC and XNUM may be updated at the update frequency in both MSN and SLEEP modes. In particular, the update and calibration process may be optional for the MSN mode, but it is critical in the SLEEP mode. At step 432, an update enable signal is generated from the ACLK clock and a number A_COUNT which specifies the number of the ACLK cycles between two updates. As a result, the update frequency is much smaller than the ACLK frequencies, and an exemplary update frequency is 1Hz. To update the number XSEC, the temperature is measured at step 434 upon receiving the update enable signal, and a certain number of XCLK clock cycles are compensated to XSEC according a predetermined XSEC-temperature relationship at step 436. To update the number XNUM, the XCLK cycles are measured within one ACLK clock cycle at step 438 upon receiving the update enable signal. The prior number of XNUM is stored as XNUM_OLD at step 440, and XNUM is subsequently updated at step 442. XSEC is updated and applied in both power modes. However, the constantly updated XNUM is critical in the SLEEP mode, and may not be used in the MSN mode at all.

In the SLEEP mode, power consumption is maintained at a low level due to time tracking by the ACLK clock. The XCLK clock consumes relatively more power, and therefore, it is preferred to reduce the update frequency and duty cycle of the calibration/update process. Although XNUM may be calibrated within one ACLK cycle (~30 μsec), a stabilization time period is required when the XCLK clock is switched on for each update. In one embodiment, the update frequency is approximately once per minute, and the calibration process may account for a duty cycle of 0.2%.

The primary and secondary oscillators may need to be isolated or decoupled to avoid frequency drift when the primary oscillator is switched on during each update cycle in the SLEEP mode. In one embodiment, a RC oscillator is employed, and in particular, power supply rejection ratio (PSRR) may reach a certain level in order to reduce the coupled frequency drift.

One second of time is used in the time keeping counter 210 and the exemplary time keeping method 400. One of those skilled in the art will recognize that one second of time is an example of an interval of time that may be tracked according to various embodiments in the invention, and this interval of time may be varied according to each individual application.

While the invention is susceptible to various modifications and alternative forms, specific examples thereof have been shown in the drawings and are herein described in detail. It should be understood, however, that the invention is not to be limited to the particular forms disclosed, but to the contrary, the invention is to cover all modifications, equivalents, and alternatives falling within the scope of the appended claims.

We claim:

1. A method of generating accurate time of day in a low power SLEEP mode, comprising the steps of:

generating a first clock and a second clock, both the frequency and the accuracy of the first clock being higher than that of the second clock, while the first clock is associated with larger power consumption than the second clock;

setting an initial value for an accumulating number that is used to track the cycles of the first clock;

during a plurality of consecutive second clock cycles, adding a cycle number to the accumulating number in each of the plurality of consecutive second clock cycles and enabling the first clock to compensate the accumulating number at an update frequency, the cycle number being associated with the number of cycles of the first clock within a cycle of the second clock; and increasing the time of day by an interval of time when the accumulating number reaches a predetermined target number representative of a number of cycles.

2. The method in claim 1, wherein the interval of time is one second of time.

3. The method in claim 1, wherein the first clock and the second clock are a high-fidelity clock generated by a primary oscillator circuit and a coarse clock generated by a secondary oscillator circuit, respectively, and the primary oscillator circuit consumes more power than the secondary oscillator circuit.

4. The method in claim 1, wherein when the first clock is enabled, the accumulating number is compensated for an error that has been introduced since last compensation.

5. The method in claim 1, wherein the cycle number is calibrated and updated when the first clock is enabled.

6. The method in claim 1, wherein the target number is calibrated and updated when the first clock is enabled.

7. The method in claim 1, wherein the first clock is generated from an AT cut crystal oscillator that has a characteristic frequency substantially equal to 16 MHz.

8. The method in claim 1, wherein the second clock is generated from an oscillator selected from a first group that consists of a watch crystal, a relaxation oscillator and a RC oscillator, and the RC oscillator is further selected from a second group that consists of a phase-shift oscillator, a ring oscillator and a Wien bridge oscillator.

9. The method in claim 1, wherein the time of day is tracked to compensate a frequency drift of the second clock, such that the accuracy of the time of day is controlled substantially to ±10 ppm over an industrial temperature range that is no narrower than [−25° C., 60° C.].

10. The method in claim 1, wherein the update frequency approximates once per minute, and the accumulating number is compensated at a frequency substantially equal to once per minute.

11. A method of generating accurate time of day according to a power budget, comprising the steps of:

determining a mode between a mission (MSN) mode and a SLEEP mode according to a power budget, the MSN mode requiring a higher power budget than the SLEEP mode;

generating a first clock and a second clock, both the frequency and the accuracy of the first clock being higher than that of the second clock, while the first clock is associated with larger power consumption than the second clock;

setting an initial value for an accumulating number that is used to count the cycles of the first clock;

increasing the accumulating number according to the mode, wherein in the MSN mode, the accumulating number is increased by one at each of a plurality of consecutive first clock cycles; and in the SLEEP mode, the accumulating number is increased by a cycle number at each of a plurality of consecutive second clock cycles, and the first clock is enabled at an update frequency to compensate the accumulating number, the cycle number being associated with the number of cycles of the first clock within a cycle of the second clock; and increasing the time of day by said interval when the accumulating number reaches a predetermined target number representative of a number of cycles.

12. The method in claim 11, wherein in the SLEEP mode, both the cycle number and the target number are calibrated and updated, when the first clock is enabled.

13. The method in claim 11, wherein the interval of time is one second of time.

14. A precision time keeping circuit in a real-time clock circuit, comprising:

a primary oscillator that generates a first clock, the primary oscillator being constantly active in a mission (MSN) mode and being enabled intermittently for calibration and compensation in a SLEEP mode;

a secondary oscillator that generates a second clock, the secondary oscillator being constantly active in the SLEEP mode, both the frequency and the accuracy of the first clock being higher than that of the second clock, while the first clock is associated with larger power consumption than the second clock is;

a compensation circuit, coupled to the primary and secondary oscillators, the compensation circuit increasing an accumulating number when the accumulating number reaches a predetermined target number representative of a number of cycles, and generating a control that indicates an interval of time;

a time keeping counter, coupled to the compensation circuit, the time keeping counter increasing the time of day by the interval of time upon receiving the control.

15. The precision time keeping circuit in claim 14, wherein the secondary oscillator is coupled to receive a multiple-bit manufacturing trim that is used to program the frequency of the second clock.

16. The precision time keeping circuit in claim 14, further comprising a temperature compensation circuit that compensates an error of the primary oscillator due to temperature drift, wherein a plurality of parameters programmed according to the primary oscillator is used for calculating amount of compensation needed.

17. The precision time keeping circuit in claim 14, wherein in the SLEEP mode, a cycle number is added to the accumulating number in each of a plurality of consecutive second clock cycles, and the first clock is enabled to compensate the accumulating number at an update frequency, the cycle number being associated with the number of cycles of the first clock within a cycle of the second clock.

18. The precision time keeping circuit in claim 7, wherein in the first clock is generated from an AT cut crystal oscillator that has a characteristic frequency substantially equal to 16 MHz.

19. The precision time keeping circuit in claim 14, wherein the second clock is generated from an oscillator selected from a first group that consists of a watch crystal, a relaxation oscillator and a RC oscillator, and the RC oscillator is further selected from a second group that consists of a phase-shift oscillator, a ring oscillator and a Wien bridge oscillator.

20. The precision time keeping circuit in claim 14, wherein in the SLEEP mode, both the cycle number and the target number are calibrated and updated, when the first clock is enabled.

* * * * *